United States Patent [19]

Wofsey

[11] 4,028,576

[45] June 7, 1977

[54] SONIC SPARK PLUG

[76] Inventor: David Wofsey, 3368 S. Ulster Court, Denver, Colo. 80231

[22] Filed: July 21, 1975

[21] Appl. No.: 597,753

[52] U.S. Cl. ..... 313/143; 313/141; 313/138

[51] Int. Cl.² ..... H01T 13/20

[58] Field of Search ..... 313/143, 141, 138, 139

[56] References Cited

UNITED STATES PATENTS

| | | | |
|---|---|---|---|
| 3,800,179 | 3/1974 | Louzecky | 313/143 X |
| 3,892,991 | 7/1975 | Joslyn | 313/143 X |

*Primary Examiner*—Rudolph V. Rolinec
*Assistant Examiner*—Darwin R. Hostetter
*Attorney, Agent, or Firm*—Berman, Aisenberg & Platt

[57] ABSTRACT

A spark plug having a cylindrical rod-shaped high voltage electrode and a metal sleeve press-fitted on the main body of the plug concentrically surrounding the electrode and having an inwardly projecting annular throat rib with a cylindrical inner surface concentrically completely surrounding the electrode and defining an annular firing space. The bottom end of the electrode extends down to at least the bottom of the cylindrical throat inner surface. Above the throat rib there is thus defined a resonating acoustical cavity, with the dimensions of the parts being such that the acoustic fundamental frequency is above ten thousand Hertz. The metal sleeve has an annular shoulder spaced from the bottom rim of the spark plug body to define an annular recess serving to induce high-multiple harmonics in the acoustic wave generated by the resonating cavity system. The annular bottom mouth of the metal sleeve is arcuately curved in a radial direction and flares downwardly and outwardly away from the annular firing space. The assembly serves to accelerate the combustion process at the instant of ignition and also generates high frequency acoustic vibrations which cavitate all the liquid fuel particles admitted into the associated cylinder to thereby increase the combustion efficiency.

7 Claims, 3 Drawing Figures

FIG. 1.
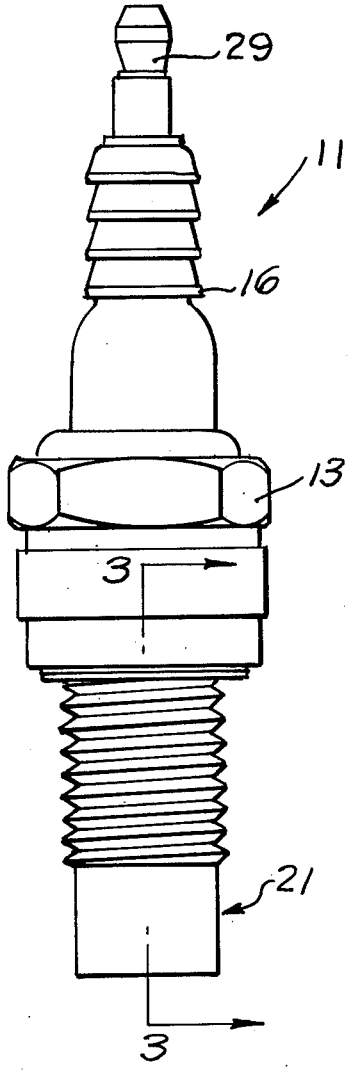
FIG. 3.
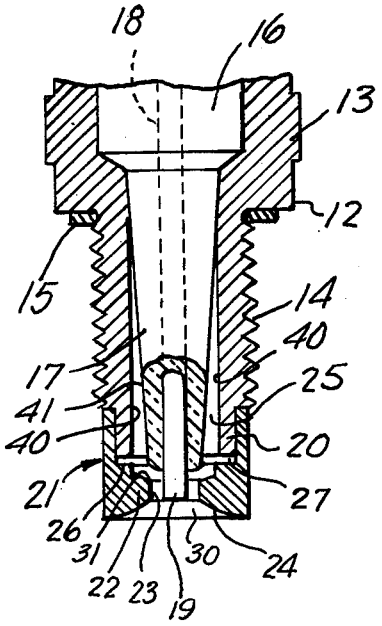
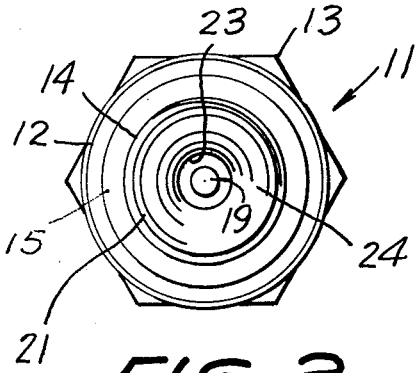
FIG. 2.

SONIC SPARK PLUG

This invention relates to spark plugs, and more particularly to a spark plug of a type having means to provide improved fuel combustion and reduce pollution emission.

A main object of the invention is to provide a novel and improved spark plug assembly employing a resonant acoustic system to cavitate the liquid fuel particles reaching the associated engine cylinder, to thereby increase the combustion efficiency by accelerating the combustion process at the instant of ignition.

A further object of the invention is to provide an improved spark plug assembly having means to generate optimum-frequency acoustic vibrations for cavitating the liquid fuel particles carried by the fuel-air mixture reaching the associated cylinder, to thereby increase the combustion efficiency and reduce pollution emission, the assembly employing easily available components, being easy to fabricate and being relatively inexpensive.

A still further object of the invention is to provide an improved spark plug assembly provided with high frequency acoustic vibration-generating means to cavitate liquid fuel particles contained in the fuel-air mixture reaching the associated cylinder, the means being activated at the instant of ignition responsive to the ignition of the fuel mixture, the cavitation acting to substantially vaporize the liquid particles, thereby promoting complete combustion, reducing pollution emission and improving the economy and performance of the associated engine, and the assembly providing increased service life of its sparking electrode as well as providing improved reliability of operation.

A still further object of the invention is to provide an improved fuel-saving and low-pollution spark plug assembly which can be fabricated from a conventional spark plug by a slight modification thereof and by the addition of an inexpensive and simple attachment which can be press-fitted to the body of the spark plug, the attachment acting to insure a more complete combustion of fuel and prolongation of the life of the spark plug firing electrode, whereby to generally improve the operating efficiency and economy of the associated engine.

A still further object of the invention is to provide an acoustic wave-generating spark plug assembly for cavitating liquid fuel particles at the instant of ignition, the assembly being arranged to develop high-multiple harmonics of its fundamental acoustic frequency to improve the cavitation action and thereby increase the fuel combustion efficiency of the associated engine, and being also arranged to provide a relatively large sparking area and to minimize extraneous sparking, whereby to reduce pitting and corrosion of its sparking electrode and thereby increase the useful life of the spark plug assembly.

Further objects and advantages of the invention will become apparent from the following description and claims, and from the accompanying drawings, wherein:

FIG. 1 is an elevational view of an improved spark plug assembly constructed in accordance with the present invention.

FIG. 2 is a bottom plan view of the spark plug assembly of FIG. 1.

FIG. 3 is a fragmentary vertical cross-sectional view of the spark plug assembly taken substantially on line 3—3 of FIG. 1.

Referring to the drawings, 11 generally designates an improved spark plug assembly constructed in accordance with the present invention. The assembly 11 comprises a substantially conventional spark plug main body 12 which is made of metal and which is generally tubular. The main body 12 has the usual hexagonal flange portion 13 for engagement by a suitable tool and is also provided with the externally threaded bottom end portion 14 adapted to threadedly engage in an engine block. An annular sealing gasket 15 is provided at the top end of the reduced externally threaded portion 14 disposed subjacent the bottom surface of the shoulder thus defined. Rigidly secured in the body 12 is an axially arranged insulator 16 of porcelain, or the like, having a downwardly tapering lower end portion 17. Rigidly secured axially in the insulator 16 is a vertical electrode 18 which is provided at its top exposed end with the standard connection terminal 29. The lower end of the conductor rod 18 projects below the bottom end of the insulator tapered portion 17 and defines an exposed rod-like electrode portion 19, as shown in FIG. 3.

The lower end of the conductive main body 12 is formed beneath the externally threaded portion 14 with a reduced portion 20. Press-fitted on the reduced portion 20 is a metal sleeve 21 which concentrically surrounds the rod-like electrode member 19 and which is formed with an inwardly projecting annular throat rib 22 having a cylindrical inner surface 23 concentrically surrounding the electrode member 19. The rib 22 is formed to define a front horn 30 and a rear horn 31. The electrode member 19 extends downwardly at least to the plane of the bottom of the cylindrical surface 23 and may extend slightly below said plane. Thus, the electrode member 19 and the circumposed cylindrical rib surface 23 are spaced to define an annular firing area.

The bottom annular mouth 24 of the metal sleeve 21 is arcuately curved in a radial direction and flares downwardly and outwardly away from said annular firing space. The bottom plane of the annular mouth 24 is relatively close to the bottom face plane of the rod-like electrode member 19 so that the vertical height of the mouth 24 is very small and so that there is a relatively small angle between the face plane of electrode member 19 and the outwardly flaring mouth surface 24, whereby to substantially inhibit extraneous sparking, namely, sparking between the bottom face of the electrode member 19 and the annular mouth surface 24.

As seen in FIG. 3, the inner surface 40 of the threaded portion 14 and the outer surface 41 of the portion 17 of the insulator 18 cooperate to define, above the rib 22, an annular acoustic resonant cavity 25 with downwardly diverging sidewalls. The cavity 25 communicates with the annular firing space 23 and cooperates therewith to form an acoustic resonating system having a fundamental resonating frequency determined by the dimensions of the component parts thereof; viz., volume of cavity 25, height of cylindrical surface 23 and radial width of the firing space defined between the electrode member 19 and said surface 23. It can be shown that the fundamental acoustic resonating frequency is proportional to the radial width of the annular firing space, and is inversely proportional to the height of the cylindrical surface 23 (the height of the firing space) and is likewise inversely proportional to the volume of the acoustic resonating chamber 25. In accordance with the present invention, these values are selected so as to yield a relatively high acoustic resonant frequency, namely, a frequency of at least ten thousand Hertz, and preferably higher, since higher acoustic frequencies are more effective in the cavitation action on liquid fuel particles presently to be described.

In order to insure the presence of a substantial amount of higher acoustic frequency vibrations in the generated acoustic wave, the sleeve 21 is provided with an internal annular shoulder 26 above the throat rib 22 and which is spaced below the bottom rim of the reduced lower end portion 20 of body 12, to thereby define an annular groove or recess 27 which act to induce high-multiple harmonics in the generated acoustic wave. The generated acoustic wave is thus relatively rich in these high-multiple harmonics, greatly improving its effectiveness in cavitating liquid fuel particles.

The spark plug 11 is installed in an engine in the conventional manner, and serves in the standard manner as a mechanism for the initiation of the combustion process in the associated internal combustion engine cylinder. In operation, as the piston of the associated cylinder rises in its compression stroke, the fuel-air mixture is compressed in the space below the spark plug, which causes a volume flow of the combustible mixture into the back cavity space 25 of the spark plug, thereby charging the back cavity space to the same pressure as the mixture in the cylinder. However, due to the front horn defined by the mouth 24 and the ratio of the mouth to throat diameter, the instantaneous pressure in the throat (firing space) will be greater than the pressure at the mouth of the spark plug. Also, the volume flow will generate a weak acoustic signal due to the series resonance of the throat with the back cavity 25 (according to the well known Helmholtz resonator principle). In addition, a second resonance of lower frequency would be generated as a result of resonance between the throat space (firing space) and the much larger cylinder cavity. At the instant of ignition, the acoustic resonances are amplified to maximum decibel sound pressure, and are propagated through the combustible mixture. Immediately following this action, the combustion charge in the back cavity 25 is fully ignited, and its pressure will increase to a peak pressure which precedes the peak pressure rise in the cylinder. This propels the ignition flame into the cylinder, and propagates the flame front at a much higher rate than is possibly obtainable with the use of a standard spark plug.

In addition, with each particle of combustion, the acoustic vibration is amplified to maximum sound pressure; this instantly cavitates liquid fuel particles which may be present to thereby enhance the combustion of the adjoining gaseous particles until the combustion process for the cycle is ended and the power stroke is completed.

Aside from the substantial increase in combustion and efficiency which is thus obtained, the spark plug 11 provides longer spark plug life, since extraneous sparking is inhibited, as above described, and much lower pollutant material is produced. The spark plug also has a self-cleaning action as a result of the high intensity sonic and ultrasonic agitation that occurs in the throat and back cavities. It will also be apparent that a substantial firing area is provided since the firing takes place between the periphery of the electrode element 19 and the cylindrical surface 23, thereby providing long electrode life because of the extension of the electrode area. Pollutant emission is reduced both as a direct result of the improved combustion efficiency and also because of the fact that the spark plug is most efficient when it is fired very close to top center of the compression stroke. It has been shown as a result of independent research that retarded spark timing and higher air-fuel mixtures produce lower pollutant emissions. By test it has been shown that the spark plug of the present invention can maintain combustion at air-fuel ratios of twenty-one: one. This, however, would probably require design modification of present carburetors in order to take advantage of the higher efficiency available by the spark plug of the present invention.

As will be readily apparent, a spark plug 11 according to the present invention may be fabricated by employing a standard spark plug, removing the horizontal arm portion of the electrode of the spark plug to form the rod-like electrode member 19 above described, and by providing a reduced portion 20 over which an attachment sleeve 21, as above described, is press-fitted to form the above-described assembly.

While a specific embodiment of an improved spark plug assembly has been disclosed in the foregoing description, it will be understood that various modifications within the spirit of the invention may occur to those skilled in the art. Therefore, it is intended that no limitations be placed on the invention, except as defined by the scope of the appended claims.

What is claimed is:

1. A spark plug comprising a generally tubular conductive main body having a hollow conductive lower end portion exteriorly threaded to engage in an engine block, said hollow end portion having an inwardly projecting rib with a cylindrical inner surface, an insulator axially secured in said main body and having a lower end extending into said hollow end portion, an electrode axially secured in said insulator and having an exposed cylindrical rod-like portion positioned within the space defined by said cylindrical inner surface whereby a ring-like firing space is formed, said hollow end portion being provided with an acoustic cavity above said firing space, defining an acoustic system whose resonant frequency is proportional to the radial width of the ring-like firing space, inversely proportional to the height of the cylindrical inner surface and inversely proportional to the volume of the acoustic cavity, and the values thereof being selected to provide an acoustic resonant frequency of at least ten thousand Hertz, wherein said exposed rod-like portion extends for at least the full height of said cylindrical inner surface of said rib, and wherein said hollow end portion has an annular bottom mouth sloping downwardly and outwardly away from said firing space to define a front horn for said system.

2. The spark plug of claim 1, wherein said acoustic cavity is formed with an annular relatively narrow recess to induce a relatively high-multiple harmonic in the acoustic wave generated by the combustion of fuel mixture in said firing space.

3. The spark plug of claim 1, wherein said hollow end portion comprises a reduced portion and a metal sleeve member secured on said reduced portion.

4. The spark plug of claim 3, wherein said metal sleeve member has an internal annular shoulder spaced below the lower end of said reduced portion to define said harmonic inducing recess.

5. The spark plug of claim 4, wherein said metal sleeve member is press-fitted on said reduced portion.

6. The spark plug of claim 1, wherein said annular bottom mouth is arcuately curved in radial cross-section and its bottom plane is relatively close to the bottom face plane of the rod-like bottom end of the electrode to inhibit spark discharges between the bottom face of the electrode and said bottom mouth.

7. The spark plug of claim 6, wherein the lower end of the main body is reduced in diameter and said metal sleeve is press-fitted on the reduced lower end portion of said main body.

* * * * *